US006658667B1

(12) United States Patent
Galante

(10) Patent No.: US 6,658,667 B1
(45) Date of Patent: Dec. 9, 2003

(54) PREKNOTTED ADJUSTABLE FABRIC NECKTIE

(75) Inventor: John Galante, Watkinsville, GA (US)

(73) Assignee: After Six, Inc., Hackensack, NJ (US)

( * ) Notice: Subject to any disclaimer, the term of this patent is extended or adjusted under 35 U.S.C. 154(b) by 19 days.

(21) Appl. No.: 10/166,905

(22) Filed: Jun. 10, 2002

(51) Int. Cl.[7] ..... A41D 25/02
(52) U.S. Cl. ..... 2/149; 2/150
(58) Field of Search ..... 2/144–150, 152.1, 2/153, 155–157; 24/49.1, 50

(56) References Cited

U.S. PATENT DOCUMENTS

| | | | | |
|---|---|---|---|---|
| 1,396,240 | A | 11/1921 | Bakerman | |
| 1,400,858 | A | 12/1921 | Boros | |
| 2,040,297 | A | 5/1936 | Costantini | |
| 2,553,437 | A | 5/1951 | Burke | |
| 3,127,618 | A | 4/1964 | Roach | |
| 3,898,698 | A | 8/1975 | Byrd et al. | |
| 4,656,672 | A | 4/1987 | Lande | |
| 4,694,509 | A | 9/1987 | Grubman | |
| 4,897,887 | A | 2/1990 | Chen et al. | |
| 5,012,530 | A | 5/1991 | Ackerman | |
| 5,048,127 | A | 9/1991 | Yang | |
| 6,421,835 | B1 * | 7/2002 | Galante | 2/149 |
| 6,460,189 | B1 * | 10/2002 | Welch | 2/145 |

* cited by examiner

*Primary Examiner*—Tejash Patel
(74) *Attorney, Agent, or Firm*—Mitchell D. Bittman

(57) ABSTRACT

The present invention provides a preknotted adjustable necktie comprising a front outer tie portion, a knot portion with an opening therethrough, and an adjustable neck embracing loop extending through the opening in said knot portion. The knot portion is formed of fabric material and contains no rigid materials, the knot portion having an outer knot segment attached on its vertically extending side edges to an inner knot segment, with one end of the neck embracing loop attached to a first side of the inner knot segment and the other end of the neck embracing loop extending through a guide loop attached to the first side of the inner knot segment, with the front outer tie portion attached to the other side of the inner knot segment, and with the outer knot segment being attached at its opposing side edges forming the opening through the knot portion.

20 Claims, 12 Drawing Sheets

PREKNOTTED ADJUSTABLE FABRIC NECKTIE

BACKGROUND OF THE INVENTION

The present invention relates generally to preknotted adjustable neckties and, more particularly to a preknotted adjustable necktie formed of fabric material and containing no rigid materials in the knot.

Heretofore, neckties were tied each time they were worn. When a necktie is tied and untied, the area where the knot is formed often becomes wrinkled or distorted. In addition, the user seldom ties the same knot each time, leading to misshaped knots. There have been at least two solutions to these problems: the clip on necktie, and the necktie having a pre-tied knot which fits around the user's neck and is adjustable by a means of a slidable zipper. Such neckties are described in U.S. Pat. Nos. 3,898,698, 4,656,672, 4,89,7887 and 5,048,127. These patents generally disclose a knot portion with a rigid plate member and a neck loop with a zipper sewn in slidably attached to the knot portion to adjust the size of the loop to fit around a user's neck. However, these pre-tied neckties use rigid materials in the knot and zippers which tend to break, are uncomfortable to wear and tend to loosen during use.

SUMMARY

The present invention provides a preknotted adjustable necktie comprising a front outer tie portion, a knot portion with an opening therethrough, and an adjustable neck embracing loop extending through the opening in said knot portion. The knot portion is formed of fabric material and contains no rigid materials, the knot portion having an outer knot segment attached on its vertically extending side edges to an inner knot segment, with one end of the neck embracing loop attached to a first side of the inner knot segment and the other end of the neck embracing loop extending through a guide loop attached to the first side of the inner knot segment, with the front outer tie portion attached to the other side of the inner knot segment, and with the outer knot segment being attached at its opposing side edges forming the opening through the knot portion.

The present invention also provides a process for forming this preknotted adjustable necktie by: forming from a fabric material the front outer tie portion as an elongated tie shaped strip, a knot portion having an outer knot segment and an inner knot segment, and a neck embracing loop; attaching a guide loop to a first side of the inner knot segment; attaching one end of the neck embracing loop to the first side of the inner knot segment and inserting the other end of the neck embracing loop through the guide loop; attaching the front outer tie portion to the other side of the inner knot segment; attaching the vertically extending side edges of the outer knot segment to the inner knot segment; and attaching the opposing side edges of the outer knot segment forming the knot portion with an opening therethrough.

BRIEF DESCRIPTION OF THE DRAWINGS

Some embodiments of the invention will now be described in greater detail, with reference to the accompanying drawings in which.

DETAILED DESCRIPTION OF THE INVENTION

Figure 1:
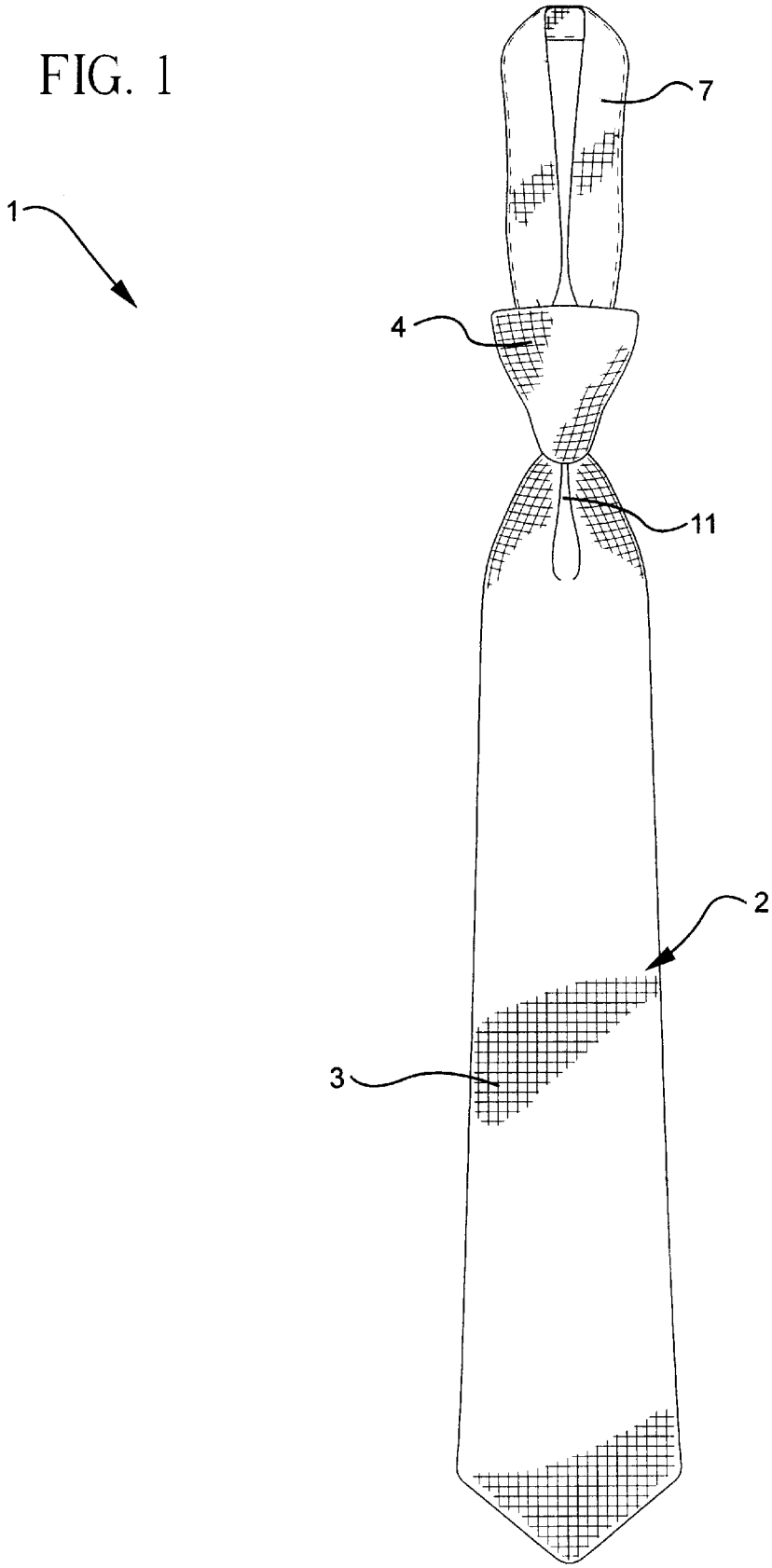
FIG. 1 is a front view of a preknotted adjustable necktie according to the invention.
Figure 2:
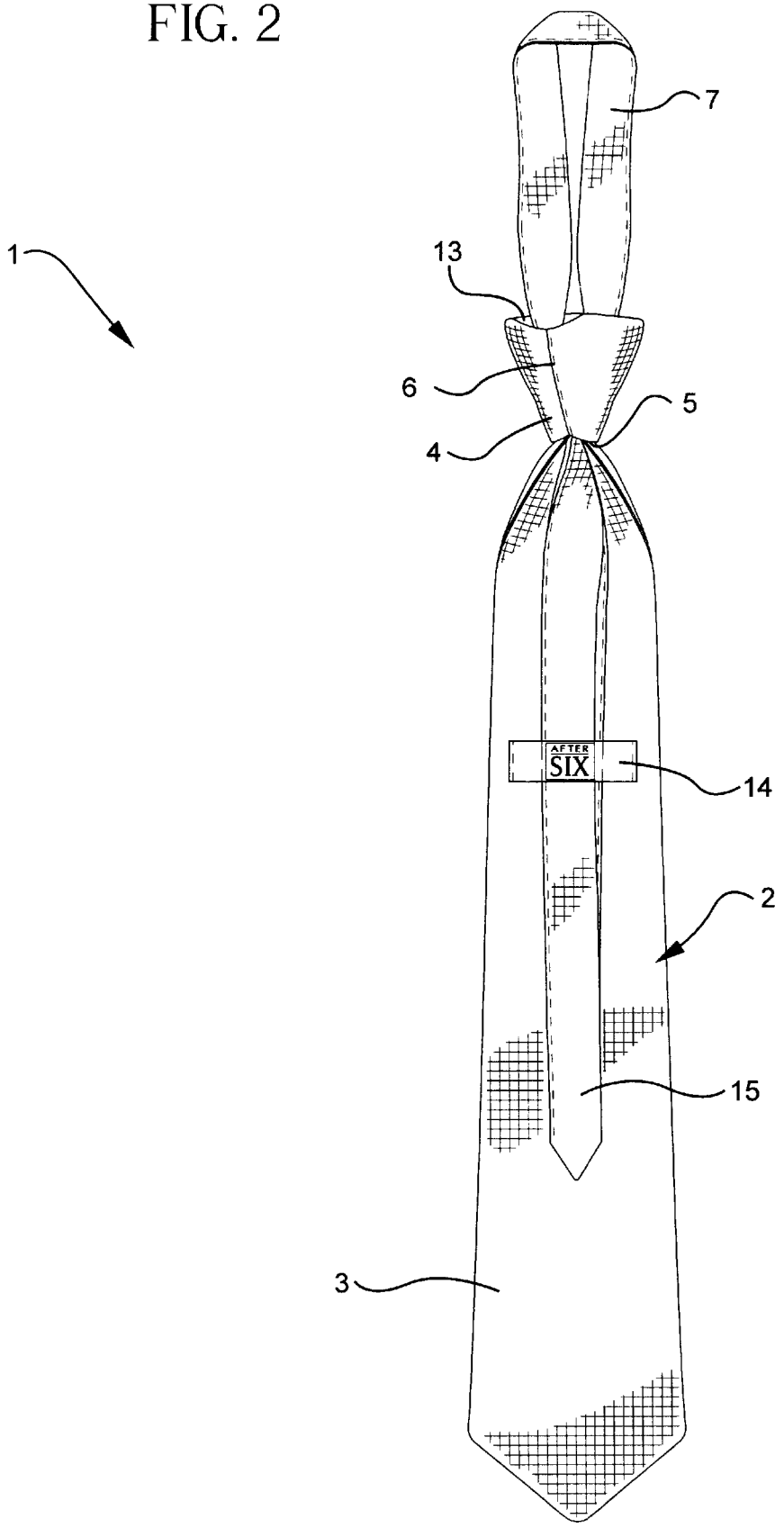
FIG. 2 is a rear view of the preknotted adjustable necktie.

Referring to the drawings FIGS. 1 and 2 the preknotted adjustable necktie 1 has a front outer tie portion 2 having a front wide flap segment 3, a knot portion 4 with an opening 5 therethrough, and an adjustable neck embracing loop 7 extending through the opening 5 in the knot portion 4.

Figure 3:
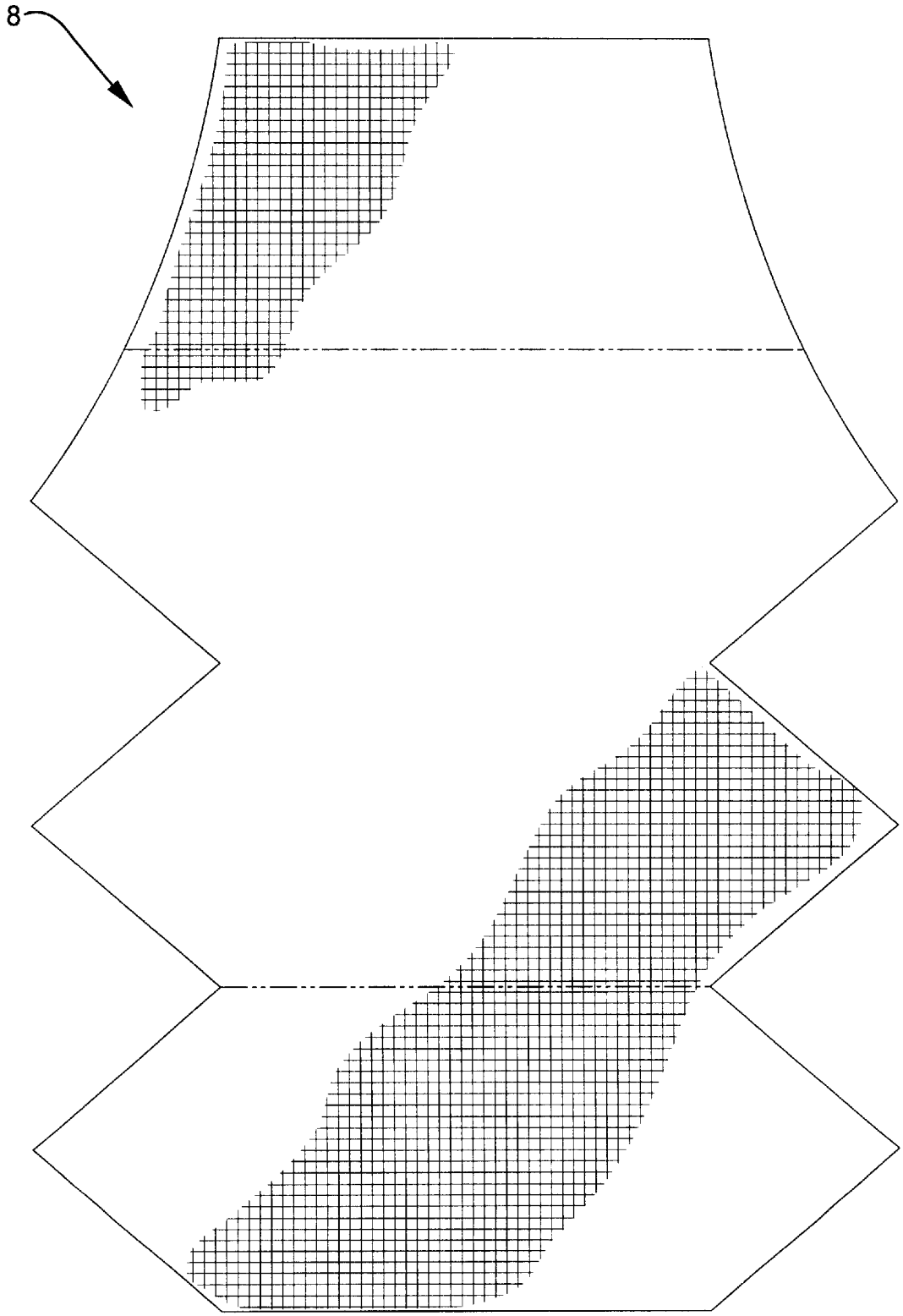
FIG. 3 is a front view of the process step wherein a pattern has been cut for forming the knot portion.
Figure 4:
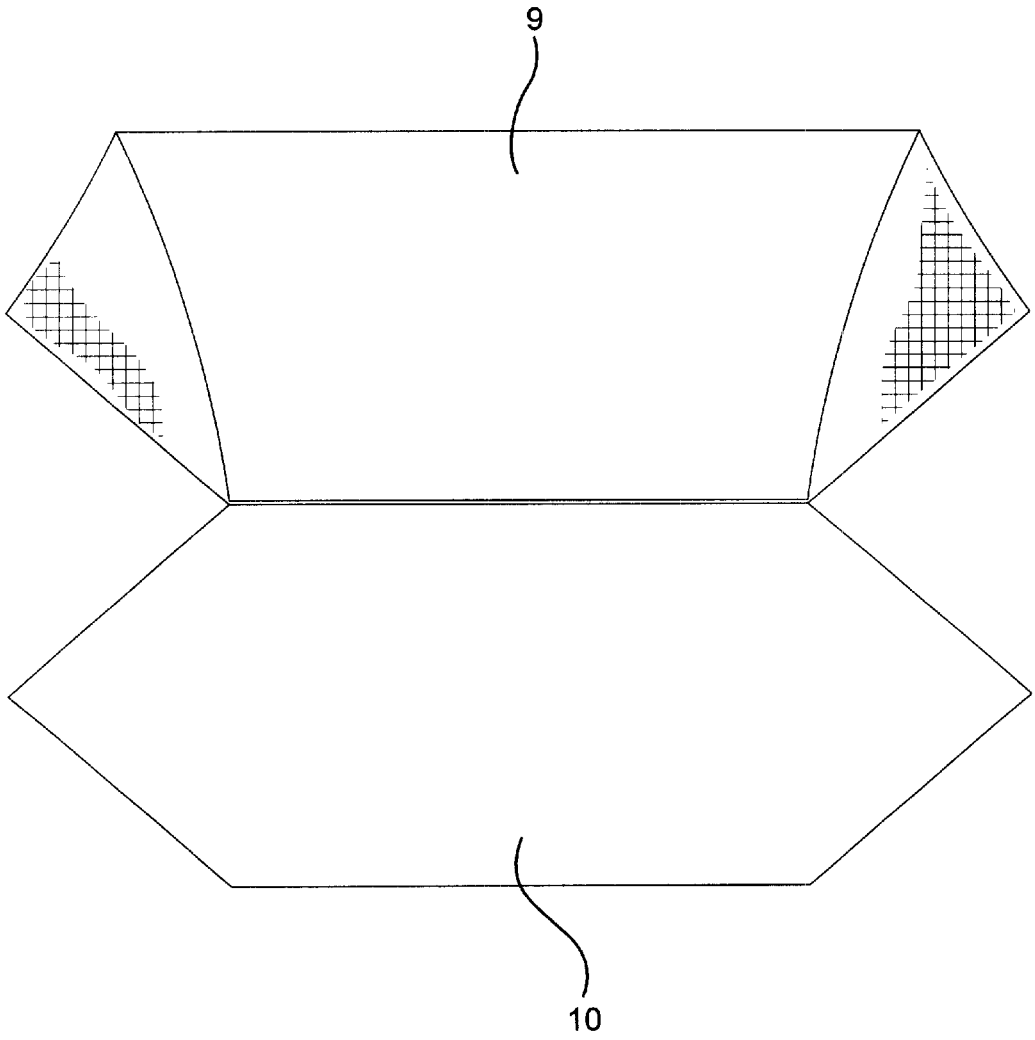
FIG. 4 is a front view of the process step wherein the outer knot segment and inner knot segment are formed by folding over and attaching the folded fabric together.
Figure 5:
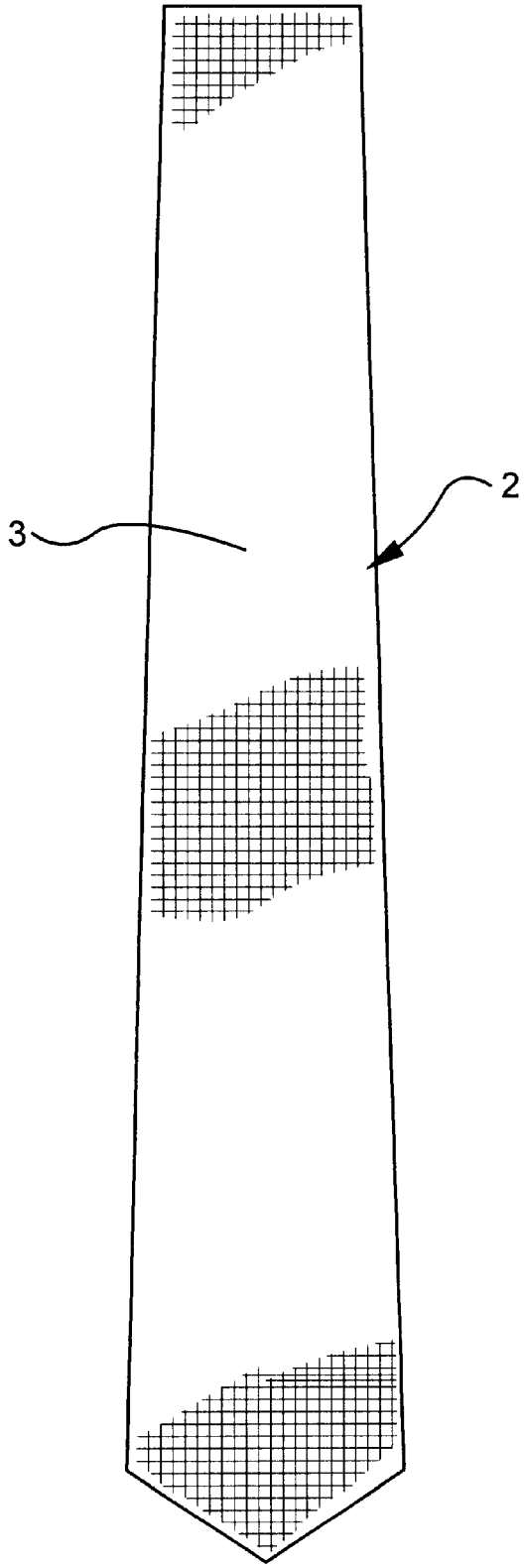
FIG. 5 is a front view of the front outer tie portion.
Figure 5A:
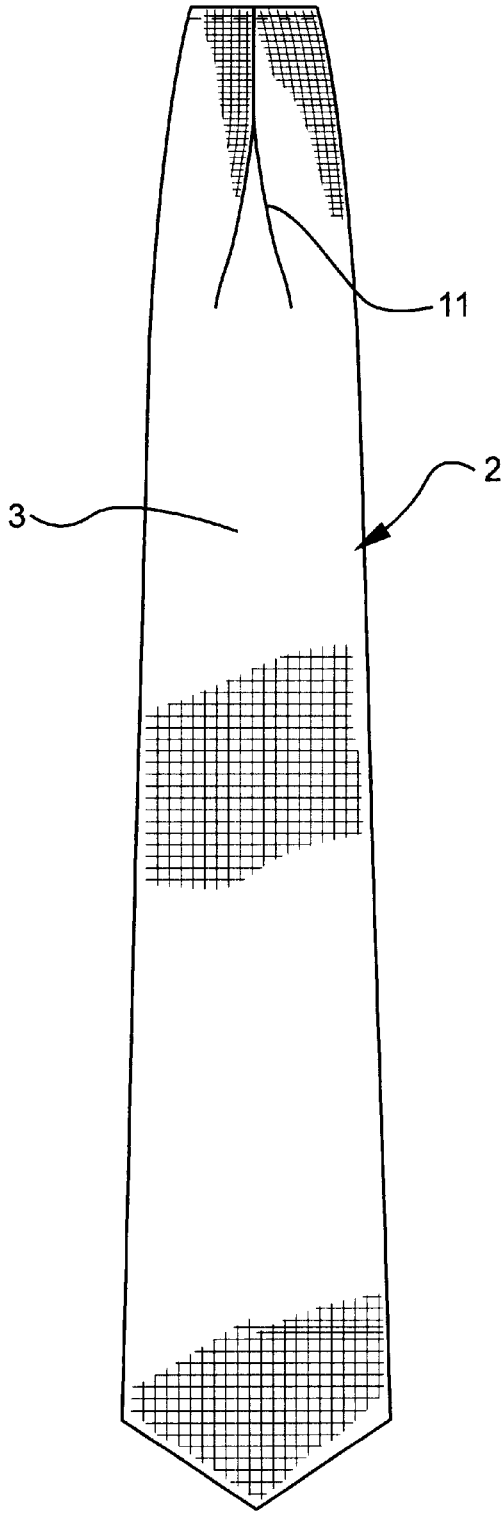
FIG. 5*a* is a front view of the front outer tie portion with a longitudinal dimple in the top section.
Figure 5B:
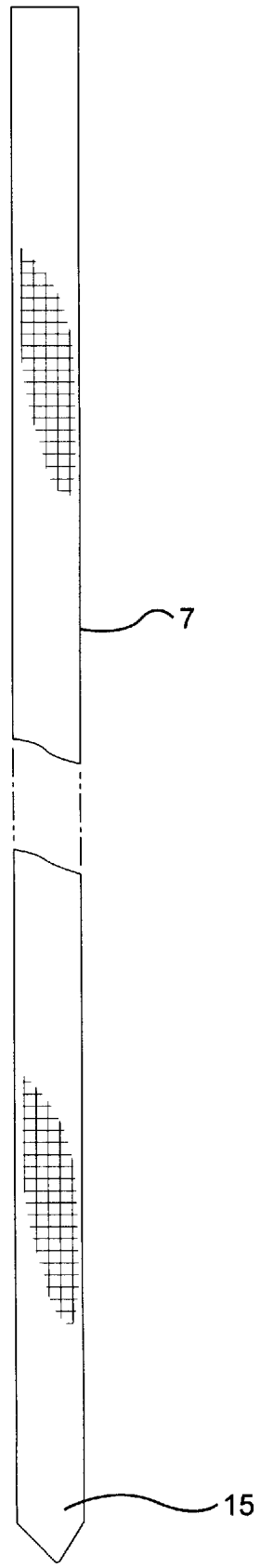
FIG. 5*b* is a front view of the neck embracing loop.

The knot portion 4 is formed of fabric material and contains no rigid materials such as a plastic, metal or stiffener to provide shape to the knot. Preferably, the knot portion is formed from a single piece of fabric. The knot portion 4 has an inner knot segment 9 attached at its vertically extending side edges to an outer knot segment 10. To provide bulk and form to the knot portion 4 preferably the outer knot segment 9 and outer knot segment 10 are formed by folding fabric and attaching the folds together. To form the knot portion 4, referring to FIG. 3, a pattern 8 is cut from a fabric which, as shown in FIG. 4, is folded forming an inner knot segment 9 and an outer knot segment 10. The front outer tie portion 2 is formed, as shown in FIG. 5, having a front wide flap segment 3. To provide a desirable appearance, preferably a longitudinal dimple (crease) 11 is formed in the front outer tie portion 2 by stitching the fabric together below the top section of the front outer tie portion 2 as shown in FIG. 5*a*. FIG. 5*b* shows the neck embracing loop 7.

Figure 6:
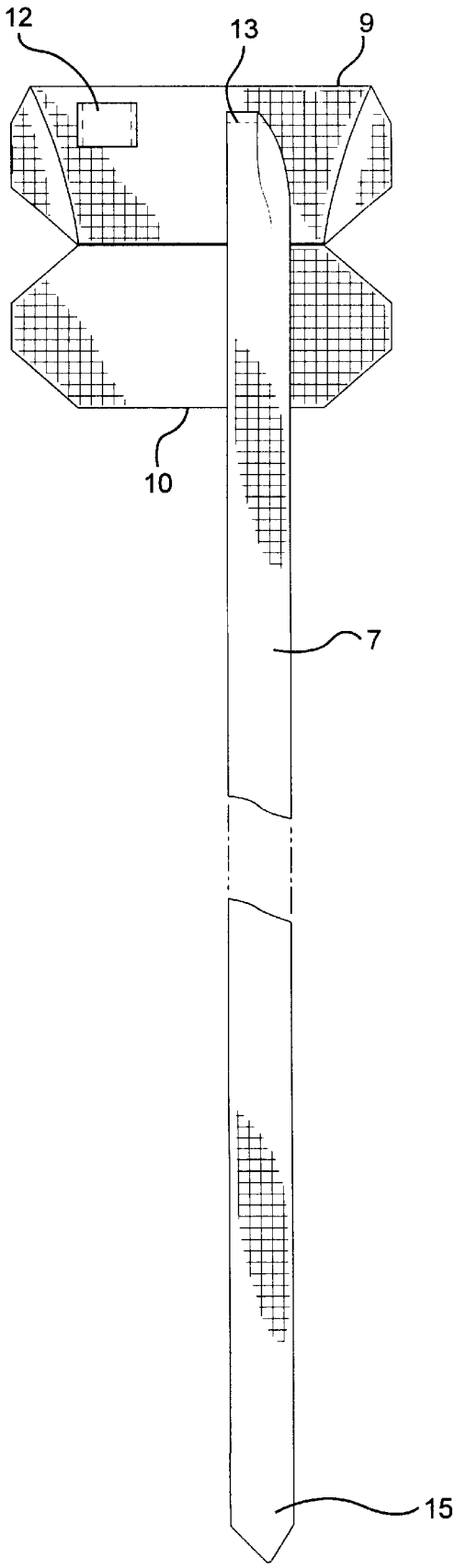
FIG. 6 is a front view of the process step wherein the guide loop and one end of the neck embracing loop are attached to a first side of the inner knot segment.

A guide loop 12 is attached to a first side of the inner knot segment 9, preferably the interior side, as shown in FIG. 6, and sized to snugly fit the neck embracing loop 7 therethrough in order to allow for manual adjustment of the position of the knot portion 4 on the neck embracing loop 7 whereas otherwise the knot portion is in a secure position on the neck embracing loop. Preferably the guide loop 12 is of a non slip fabric (e.g. an elastic or rough material) to help maintain the knot portion in a secure position after adjustment. One end of the neck embracing loop 7 is secured 13 (e.g. stitched) to the first side of the inner knot segment 9, preferably the interior side (see FIG. 6), and the other free end 15 of the neck embracing loop 7 extends through the guide loop 12 (see FIG. 9*a*) and through the opening 5 in the knot portion 4 (see FIG. 2). The necktie can also have a label loop 14 attached to the inner side of the front wide flap segment 3 which is used to secure the loose lower end 15 of the neck embracing loop 7. The label loop 14 commonly will have a trademark of the manufacturer or designer printed thereon (herein the registered trademark AFTER SIX is depicted). Preferably, a rigid material 17 can be attached at the end 15 of the neck embracing loop 7 to prevent it from being pulled through the guide loop 12 and/or the label loop 14.

Figure 7:
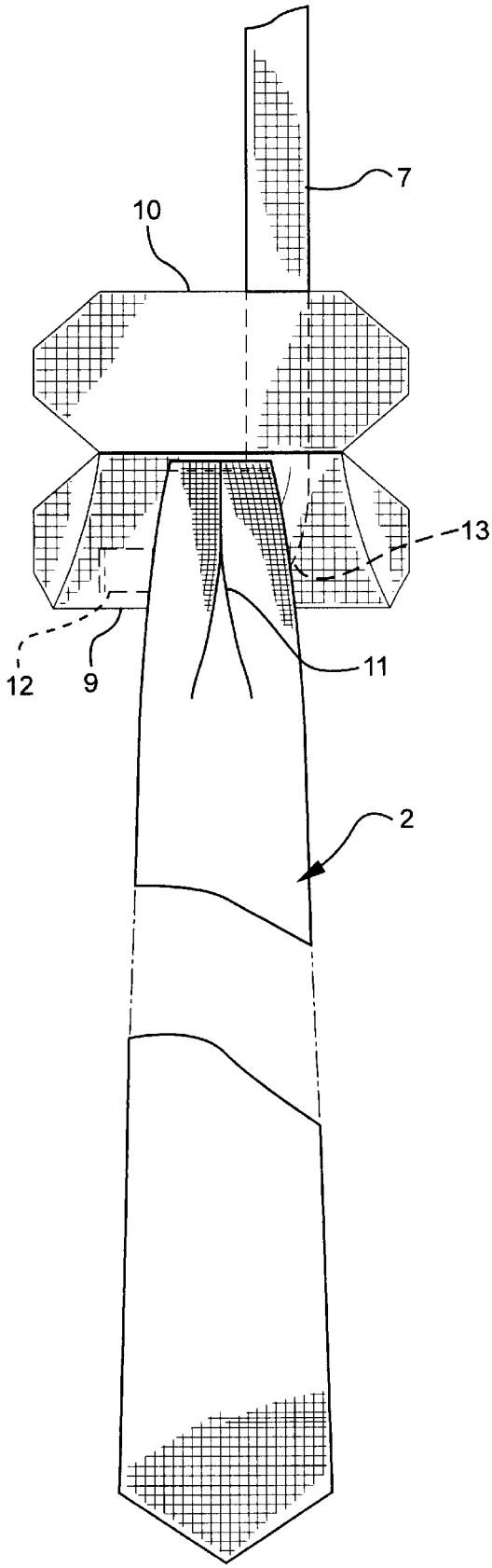
FIG. 7 is a rear view of the process step wherein the front outer tie portion is attached to the other side of the inner knot segment.
Figure 8:
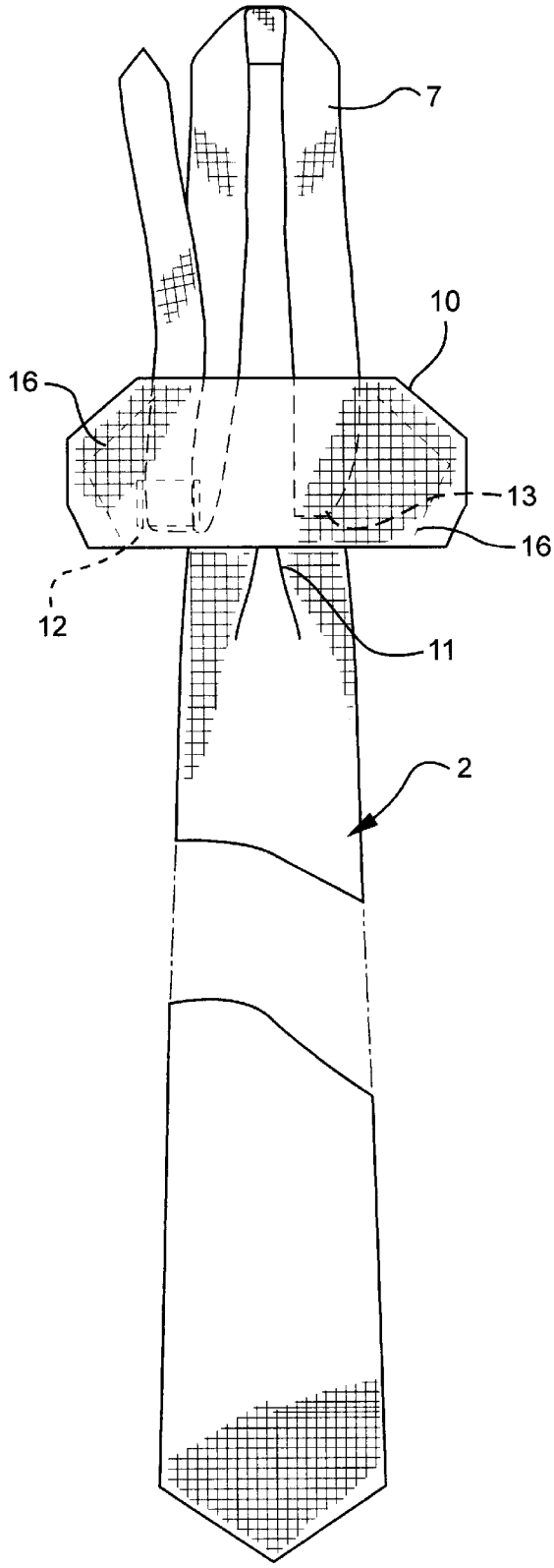
FIG. 8 is a front view of process step wherein the vertically extending side edges of the outer knot segment are attached to the inner knot segment.

The front outer tie portion 2 is attached to the other side, preferably the exterior side, of the inner knot segment 9 as shown in FIG. 7. The loose end 15 of the neck embracing loop 7 is inserted in guide loop 12. The outer knot segment 10 is folded over the inner knot segment 9 as shown in FIG. 8 and the vertically extending side edges 16 of the outer knot segment 10 and the inner knot segment 9 are attached.

Figure 9:
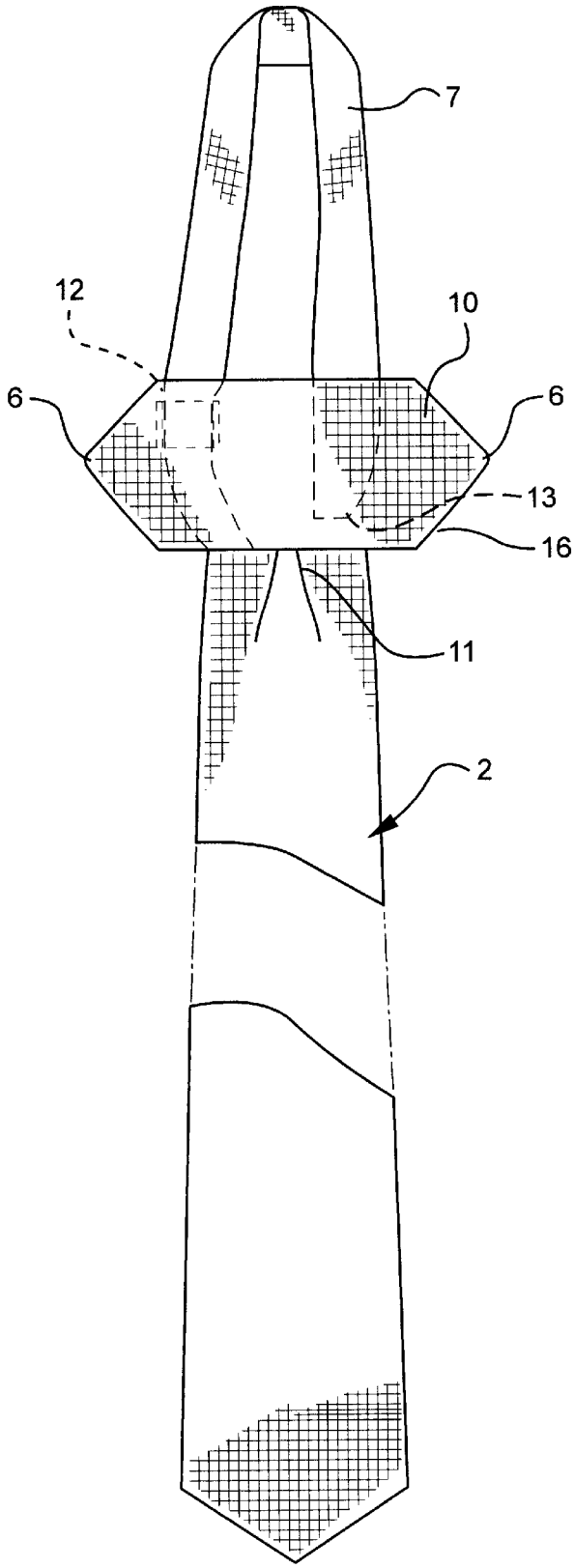
FIG. 9 is a front view of the process step wherein the knot portion is turned inside out.
Figure 9A:
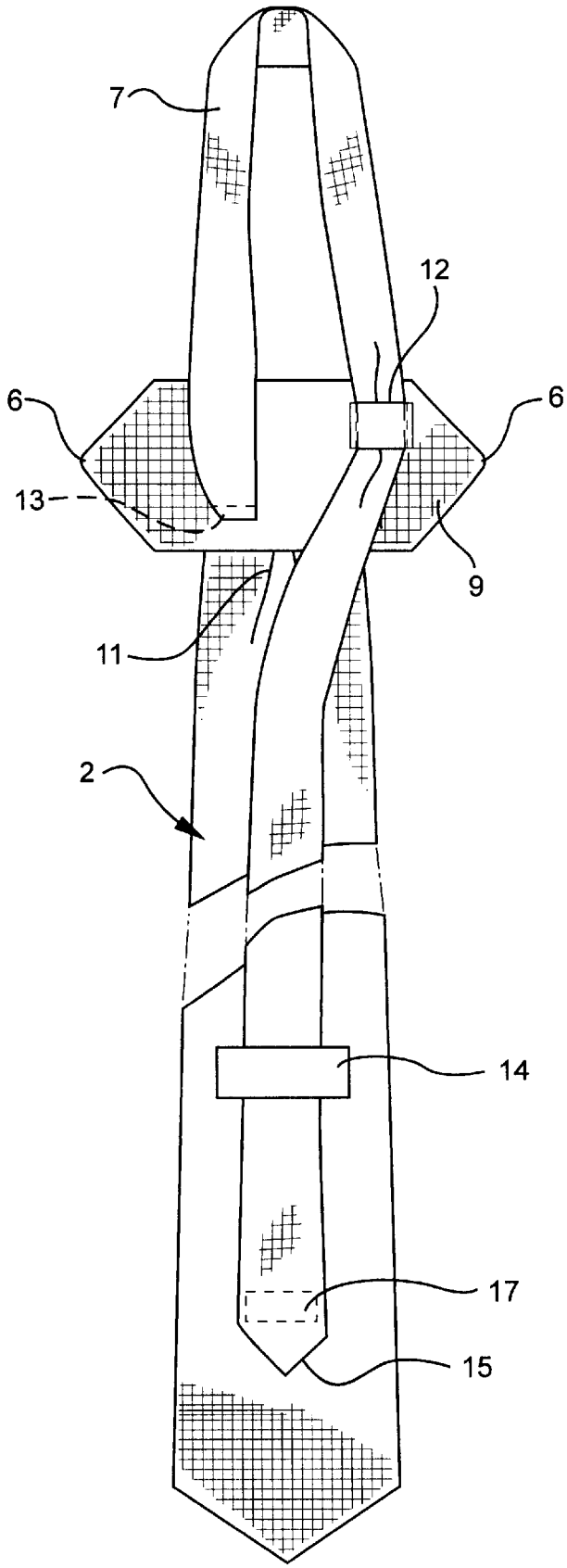
FIG. 9*a* is a rear view of FIG. 9.

The inner knot segment 9 and outer knot segment 10 of the knot portion 4 are then folded inside out as shown in FIGS. 9 and 9*a* and the knot portion is completed by attaching the opposing side edges 6 of the outer knot segment 10 forming the knot portion 4 with the opening 5 therethrough.

It should be understood that the order of the process steps can be varied to produce the preknotted adjustable fabric necktie.

What is claimed is:

1. A preknotted adjustable necktie comprising:

a front outer tie portion;

a knot portion with an opening therethrough;

an adjustable neck embracing loop extending through the opening in said knot portion;

wherein the knot portion is formed of fabric material and contains no rigid materials, the knot portion having an outer knot segment attached on its vertically extending side edges to an inner knot segment, with one end of the neck embracing loop attached to a first side of the inner knot segment and the other end of the neck embracing loop extending through a guide loop attached to the first side of the inner knot segment, with the front outer tie portion attached to the other side of the inner knot segment, and with the outer knot segment being attached at its opposing side edges forming the opening through the knot portion.

2. Necktie of claim 1, wherein the knot portion is formed from a single piece of fabric material with the outer knot segment folded over and attached at its vertically extending side edges to the inner knot segment.

3. Necktie of claim 1 wherein there is a longitudinal dimple in the top section of the front outer tie portion.

4. Necktie of claim 1 wherein the opening in the guide loop is sized to snugly fit the neck embracing loop therethrough in order to allow for manual adjustment of the position of the knot portion on the neck embracing loop whereas otherwise the knot portion is in a secure position on the neck embracing loop.

5. Necktie of claim 4 wherein the guide loop is comprised of a non slip fabric.

6. Necktie of claim 1 further comprising a label loop attached to an inner side of the front outer tie portion with the neck embracing loop extending therethrough.

7. Necktie of claim 1 further comprising a rigid material placed at the free end of the neck embracing loop passing through the guide loop and the label loop to prevent the free end of the neck embracing loop from being pulled through the guide loop and/or the label loop during use.

8. Necktie of claim 2 wherein the outer knot segment is a folded over fabric attached together and the inner knot segment is a folded over fabric attached together.

9. Necktie of claim 8 wherein the knot portion is turned inside out.

10. Necktie of claim 1 wherein the front outer tie portion is attached to the exterior of the inner knot segment and one end of the neck embracing loop and the guide loop are attached to the interior of the inner knot segment.

11. A process for forming a preknotted adjustable necktie comprised of a front outer tie portion, a knot portion with an opening therethrough and a neck embracing loop extending through the opening in the knot portion, wherein the knot portion is formed of fabric material and contains no rigid materials comprising:

forming from a fabric material the front outer tie portion as an elongated tie shaped strip, the knot portion having an outer knot segment and an inner knot segment, and a neck embracing loop;

attaching a guide loop to a first side of the inner knot segment;

attaching one end of the neck embracing loop to the first side of the inner knot segment and inserting the other end of the neck embracing loop through the guide loop;

attaching the front outer tie portion to the other side of the inner knot segment;

attaching vertically extending side edges of the outer knot segment to the inner knot segment; and attaching the opposing side edges of the outer knot segment forming the knot portion with an opening therethrough.

12. Process of claim 11 further comprising forming the knot portion from a single piece of fabric material by folding the outer knot segment over the inner knot segment, prior to attaching the vertically extending side edges of the outer knot segment to the inner knot segment.

13. Process of claim 12 further comprising forming the outer knot segment by folding over and attaching the folded fabric together and forming the inner knot segment by folding over and attaching the folded fabric together.

14. Process of claim 13 further comprising turning the knot portion inside out prior to attaching the opposing side edges of the outer knot segment.

15. Process of claim 11 further comprising forming a longitudinal dimple in the top section of the front outer tie portion prior to attachment to the inner knot segment.

16. Process of claim 11 further comprising sizing the opening in the guide loop to snugly fit the neck embracing loop therethrough in order to allow for manual adjustment of the position of the knot portion on the neck embracing loop whereas otherwise the knot portion is in a secure position on the neck embracing loop.

17. Process of claim 16 wherein the guide loop is comprised of a non slip fabric.

18. Process of claim 16 further comprising attaching a label loop to the inner side of the front outer tie portion with the neck embracing loop extending therethrough.

19. Process of claim 18 further comprising placing a rigid material at the free end of the neck embracing loop passing through the guide loop and the label loop to prevent the neck embracing loop from being pulled through the guide loop and/or the label loop during use.

20. Process of claim 11 wherein the guide loop and the one end of the neck embracing loop are attached to the interior of the inner knot segment and the front outer tie portion is attached to the exterior of the inner knot segment.

* * * * *